US007712412B2

(12) United States Patent
Kobayashi

(10) Patent No.: US 7,712,412 B2
(45) Date of Patent: May 11, 2010

(54) STENCIL PRINTER WITH PRESSING MEMBER AND MOVING DEVICE INTEGRALLY MOVABLE OUT OF PRINTER BODY

(75) Inventor: Kazuyoshi Kobayashi, Miyagi (JP)

(73) Assignee: Tohoku Ricoh Co., Ltd., Miyagi (JP)

( * ) Notice: Subject to any disclaimer, the term of this patent is extended or adjusted under 35 U.S.C. 154(b) by 774 days.

(21) Appl. No.: 11/519,006

(22) Filed: Sep. 12, 2006

(65) Prior Publication Data

US 2007/0209534 A1 Sep. 13, 2007

(30) Foreign Application Priority Data

Sep. 21, 2005 (JP) ..... 2005-273237
Jun. 14, 2006 (JP) ..... 2006-164684

(51) Int. Cl.
*B41L 13/06* (2006.01)

(52) U.S. Cl. ..... 101/118; 101/116; 101/479

(58) Field of Classification Search ..... 101/116–120, 101/479
See application file for complete search history.

(56) References Cited

U.S. PATENT DOCUMENTS 6,295,924 B1 * 10/2001 Nishihata et al. ..... 101/116
2003/0127001 A1 * 7/2003 Kanno ..... 101/116

FOREIGN PATENT DOCUMENTS

JP 64-16355 1/1989
JP 2005-125716 5/2005

* cited by examiner

*Primary Examiner*—Leslie J Evanisko
(74) *Attorney, Agent, or Firm*—Oblon, Spivak, McClelland, Maier & Neustadt, L.L.P.

(57) ABSTRACT

A stencil printer of the present invention includes a printer body, a print drum rotatably mounted on the printer body, a press roller for pressing a sheet against the circumferential surface of the print drum, and a moving device for selectively moving the press roller into or out of contact with the outer circumference of the print drum. The press roller and moving device are capable of being pulled out from the printer body integrally with each other.

26 Claims, 9 Drawing Sheets

STENCIL PRINTER WITH PRESSING MEMBER AND MOVING DEVICE INTEGRALLY MOVABLE OUT OF PRINTER BODY

BACKGROUND OF THE INVENTION

1. Field of the Invention

The present invention relates to a stencil printer for printing an image on a sheet by pressing the sheet against a master wrapped round a print drum with pressing means and a stencil printer capable of printing images on both surfaces of a sheet in a single step.

2. Description of the Prior Art

A digital, thermosensitive stencil printer is known as a relatively simple, convenient printer and uses a stencil made up of a thermoplastic resin film and a porous support adhered together. In the stencil printer, while a thermal head, provided with a number of heat generating devices, is held in contact with the stencil, a platen roller or similar conveying means conveys the stencil. At this instant, current is selectively fed to the heat generating devices in the form of pulses in order to perforate, or cut, the thermoplastic resin film of the stencil with heat in accordance with image data, thereby producing a master.

After the master thus produced has been wrapped round a porous print drum, a sheet is pressed against the print drum via the master by a press roller or similar pressing means with the result that ink, applied to the inner periphery of the print drum, is transferred to the sheet via the porous portion of the print drum and perforations formed in the master, printing an image on the sheet.

Generally, in the stencil printer described above, the press roller is rotatably supported by a pair of arm members constantly biased toward the print drum by biasing means. The arm members are caused to angularly move by, e.g., cams rotatable in synchronism with the rotation of the print drum, selectively moving the press roller into or out of contact with the print drum. To prevent the sheet being conveyed toward or away from the press roller from getting under the press roller, it is a common practice to locate a guide plate, frame included in sheet conveying means or similar member in the vicinity of the press roller upstream or downstream of the press roller in the direction of sheet conveyance.

The problem with the above stencil printer is that because a space available around the press roller is limited, it is difficult to replace the press roller when the press roller is worn out due to repeated operation or to remove a sheet when the sheet gets under the press roller due to some cause and brings about a jam.

In light of the above, Japanese Patent Laid-Open Publication No. 64-16355, for example, proposes a stencil printer including a press roller rotatably, removably supported by a pair of press roller arms which are, in turn, angularly movably supported by the printer body. The press roller arms are mounted on a shaft in such a manner as to be movable in the axial direction of the shaft and unlockable from an arm stay affixed to the above shaft, so that the press roller can be removed from the printer body.

The current trend in the imaging art is toward a duplex printing system configured to print images on both surfaces of a single sheet for, e.g., saving sheets and spaces for the storage of documents. Japanese Patent Laid-Open Publication No. 2005-125716, for example, discloses an example of a stencil printer capable of producing a print carrying images on both surfaces thereof, i.e., a duplex print in a single step. The single step, duplex printing type of stencil printer taught in this document uses a divided master in which a first and a second image are formed side by side in the direction of rotation of a print drum, and is constructed to print one of the two images on one surface of a first sheet fed from a sheet feeding section, guide the sheet to an auxiliary tray, print the above image on one surface of a second sheet also fed from the sheet feeding section, guide the second sheet to the auxiliary tray while again feeding, or refeeding, the first sheet from the auxiliary tray, print the other image on the reverse surface of the first sheet, discharge the resulting duplex print, and repeat such a procedure thereafter.

However, the prior art stencil printers stated above have some problems left unsolved, as will be described hereinafter.

The stencil printer taught in Laid-Open Publication No. 64-16355 has a drawback that a space available around the press roller is too small to efficiently mount or dismount the press roller. This makes the replacement of the press roller or the removal of a jamming sheet troublesome. This is also true with the stencil printer of Laid-Open Publication No. 2005-125716. Another problem with Laid-Open Publication No. 2005-125716 is that a refeed tray adapted to temporarily store a sheet carrying an image on one surface thereof, i.e., a simplex print is configured to angularly move integrally with the press roller, making the removal of a sheet jamming the refeed tray difficult to perform.

Further, a modern stencil printer is constructed such that a print drum is removable from the printer body in order to implement, e.g., color printing. In this case, while the print drum is generally pulled out from the printer body to the front along, e.g., rail members and then removed from the printer body, no members should preferably exist below the print drum to allow the print drum to move downward when being removed from the printer body. Should the print drum with an uncovered surface contact any other member at the time of removal, the uncovered surface would be scratched or otherwise damaged and would render printing defective.

The stencil printer disclosed in Laid-Open Publication No. 2005-125716 mentioned earlier includes refeeding means for temporarily storing a simplex sheet come out of a printing section and again feeding it toward the printing section. When the simplex print thus existing on the refeeding means is caused to overlap the next sheet without being refed due to some cause and jams the refeeding means or when a jam occurs with the edge of a sheet being left on the refeeding means due to the short conveying force of the refereeing means, it is difficult to remove the jamming sheet because the space available for such work is extremely limited.

SUMMARY OF THE INVENTION

It is an object of the present invention to provide a stencil printer capable of allowing pressing means to be easily replaced or allowing a jamming sheet to be easily removed while protecting the surface of a print drum from damage during mounting or dismounting and a stencil printer implementing single step, duplex printing.

A stencil printer of the present invention includes a printer body, a print drum rotatably mounted on the printer body, a pressing member configured to press a sheet against the circumferential surface of the print drum, and a moving device configured to selectively move the pressing member into or out of contact with the outer circumference of the print drum. The pressing member and moving device are capable of being pulled out from the printer body integrally with each other.

Also, a stencil printer of the present invention operable in a duplex print mode for printing an image on one surface of a sheet and then printing an image on the reverse surface of the sheet includes a printer body. A printing section includes a print drum configured to wrap a divided master, which has a first image and a second image formed therein side by side in the direction of rotation of the print drum, round the print drum and pressing member selectively movable into or out of contact with the print drum. A sheet discharging section discharges the sheet undergone printing at the printing section. A refeeding device temporarily supports the sheet carrying the image on the one surface thereof and then refeeds it toward the printing section. A path selector steers the sheet passed through the printing section to either one of the refeeding device and a sheet discharging device. The printing section further includes a moving device configured to selectively move the pressing member into or out of contact with the print drum. The pressing member and moving device are capable of being pulled out of the printer body integrally with each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
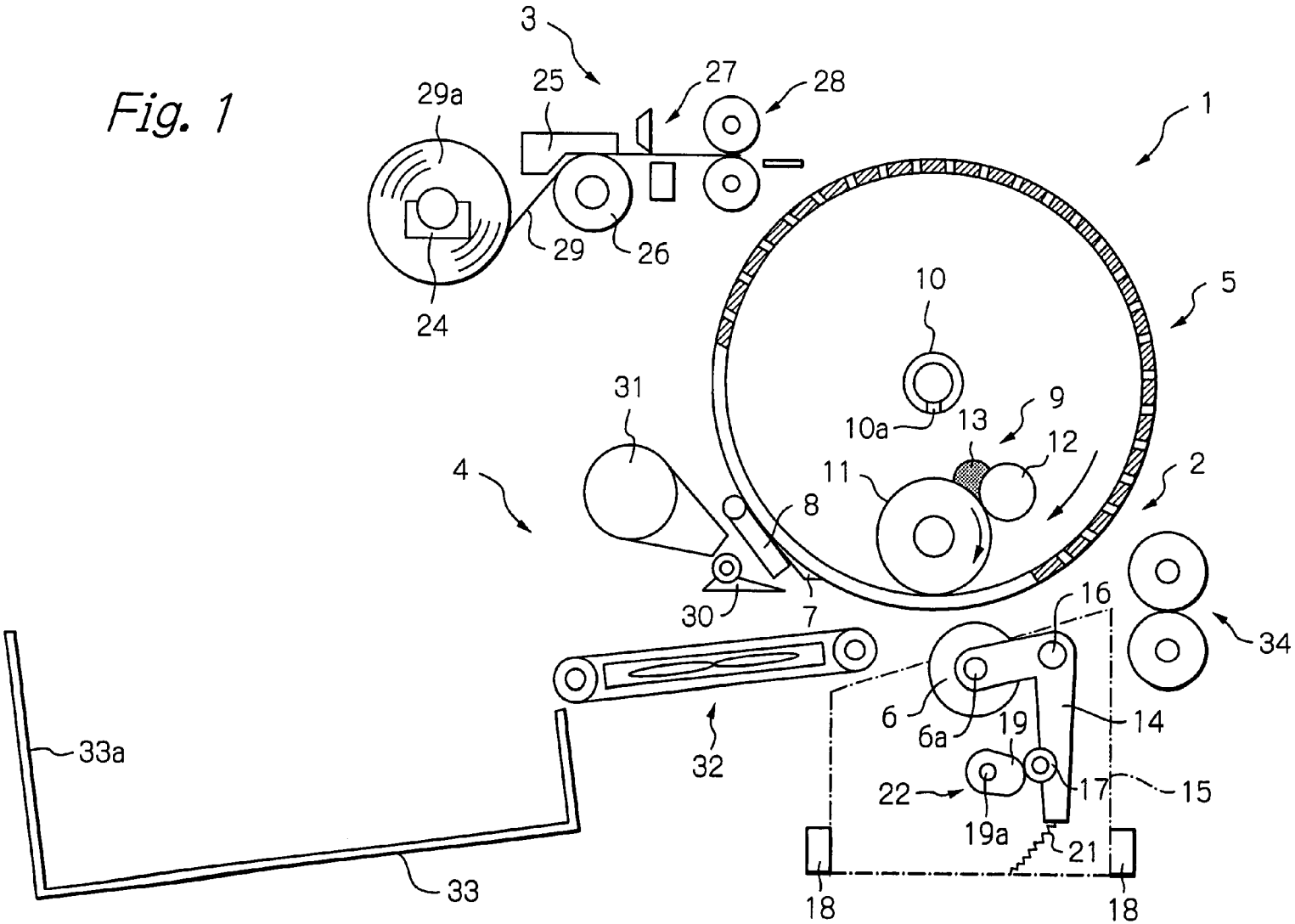
FIG. 1 is a front view showing the general construction of a first embodiment of the stencil printer in accordance with the present invention.

Referring to FIG. 1 of the drawings, a first embodiment of the stencil printer in accordance with the present invention is shown and generally designated by the reference numeral 1. As shown, the stencil printer 1 includes a printing section 2, a master making section 3 and a sheet discharging section 4.

Figure 3:
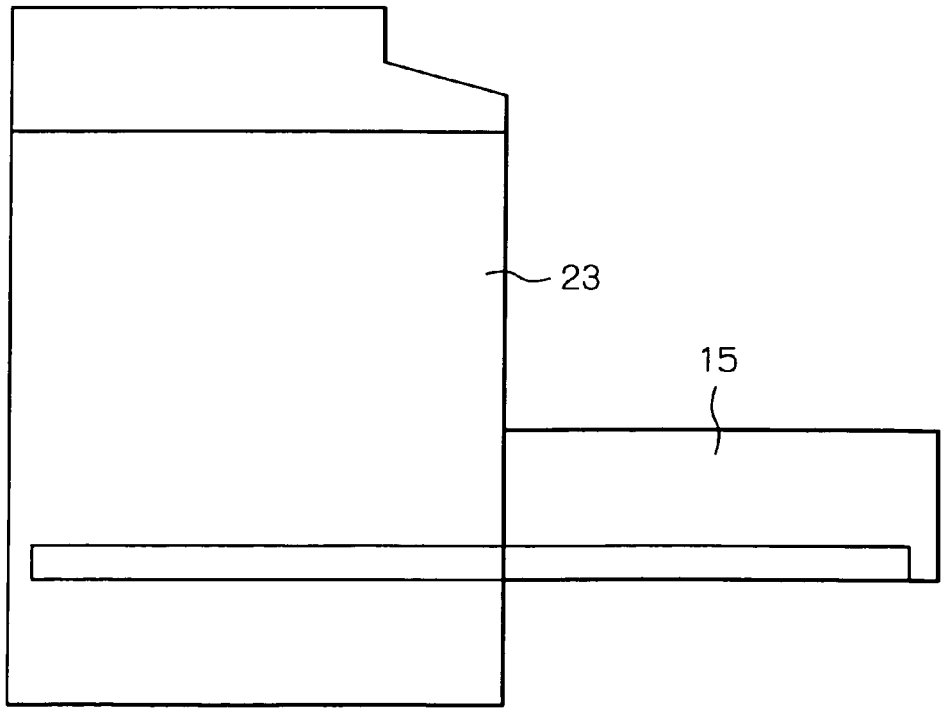
FIG. 3 is a view showing a support member also included in the first embodiment.

The printing section 2 is positioned at substantially the center of a printer body or casing 23, see FIG. 3, and includes a print drum 5 configured to rotate clockwise, as viewed in FIG. 1, by being driven by print drum drive means not shown. A press roller or pressing means 6 is movable into or out of contact with the circumferential surface of the print drum 5 and configured to press, when in contact with the print drum 5, a sheet fed from a sheet feeding section, not shown, against the print drum 5.

The print drum 5 is generally made up of a porous support plate affixed at opposite edges thereof to the circumferential surfaces of a pair of end plates, not shown, and a mesh screen wrapped round the support plate in a plurality of layers. The porous support plate includes a porous portion formed with a plurality of through holes and a non-porous portion. A stage 7 is mounted on the non-porous portion of the support plate in a flat position along the axis of the print drum 5 while a clamper 8 is mounted on the stage 7 and supported by a shaft in such a manner as to be openable away from the stage. The clamper 8 is opened and closed when the print drum 5 is rotated to a preselected position not shown.

Ink feeding means 9 is arranged inside the print drum 5 and includes an ink feed pipe 10, playing the role of a print drum shaft at the same time, an ink roller 11 and a doctor roller 12. The ink feed pipe 10 extends between the opposite endplates mentioned above and supports a pair of end plates, not shown, such that the end plates are freely rotatable via respective bearings. An ink pump and an ink pack, not shown, are fluidly connected to the ink feed pipe 10 and configured such that when the ink pump is operated, ink in the ink pack is delivered to the inner periphery of the print drum 5 via a plurality of holes 10*a* formed in the pipe 10.

The ink roller 11 is positioned between a pair of end plates, not shown, affixed to the ink feed pipe 10 and rotatably supported by the end plates. More specifically, the ink roller 11 is driven by drive means, not shown, to rotate in synchronism with and in the same direction as the print drum 5. The circumferential surface of the ink roller 11 is spaced from the inner periphery of the print drum 5 by a small gap.

The doctor roller 12 is positioned in the vicinity of the ink roller 11 and rotatably supported by the same end plates as the ink roller 11 in such a manner as to be rotated in synchronism with, but in the opposite direction to the ink roller 11 by drive means not shown. The ink roller 11 and doctor roller 12 are spaced from each other by a small gap. A space with a generally wedge-shaped cross-section is formed at a position where the ink roller 11 and doctor roller 12 adjoin each other, forming an ink well 13.

The ink fed from the holes of 10*a* of the ink feed pipe 10 is caused to drop into the above inkwell 13 and then deposited on the circumferential surface of the ink roller 11 in the form of a thin layer when passing through the portion where the ink roller 11 and doctor roller 12 adjoin each other. When the press roller 6 is moved into pressing contact with the print drum 5, the ink roller 11 and the inner periphery of the print drum 5 are caused to contact each other with the result that the ink is fed to the inner periphery of the print drum 5.

Figure 2:
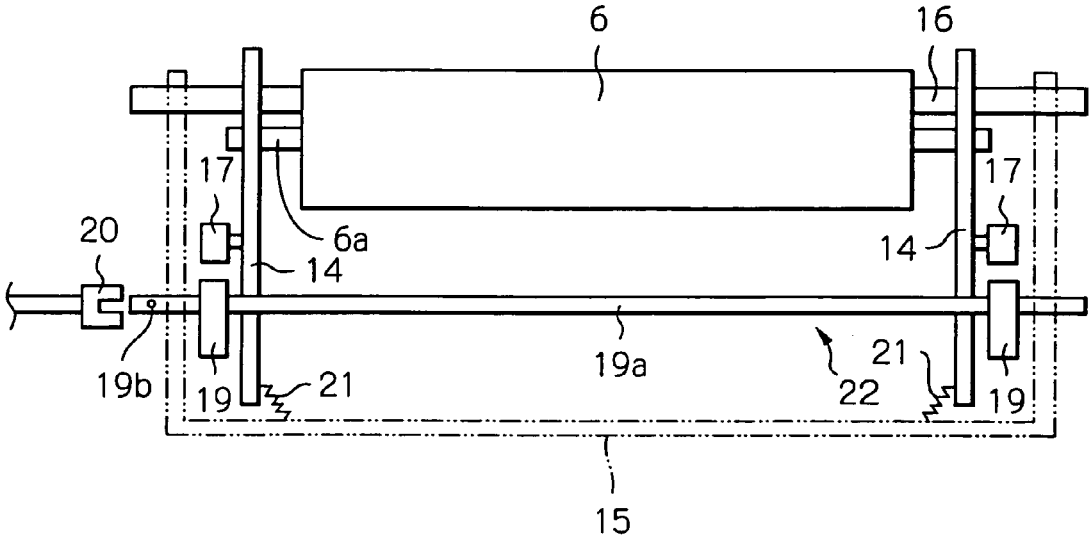
FIG. 2 is a view showing a mechanism supporting a press roller included in the first embodiment.

More specifically, the press roller 6 is positioned below the print drum 5. As shown in FIG. 2, the press roller 6 is provided with substantially the same axial length as the print drum 5 and made up of a core 6*a* and a rubber or similar elastic body wrapped round the core 6*a*. Axially opposite ends of the core 6*a* are positioned between a pair of generally L-shaped press rollers 14, and each is rotatably supported by one end of the respective press roller arm 14. Each press roller arm or flat plate-like member 14 is rotatably supported at its bent portion by a shaft 16 mounted on a support member 15.

The support member 15 mentioned above is mounted on the printer body 23 such that it can be pulled out along rails or guide members 18 also mounted on the printer body 23 toward the front, as shown in FIG. 3. Usually, the support member 15 is locked to the printer body 23 by a locking device not shown. A cam follower 17 is rotatably mounted on the other end portion of each press roller arm 14.

Two cams 19 are affixed to a cam shaft 19*a* in the vicinity of the cam follower 17 while the cam shaft 19*a* is rotatably supported by the support member 15. A pin 19*b* is affixed to one end of the cam shaft 19*a* while being passed therethrough. When the support member 15 is mounted to the printer body 23, a coupling 20, positioned on the printer body 23, is engaged with the pin 19*b*. Torque output from the print drum drive means is transmitted to the coupling 20 so as to cause, when the pin 19*b* and coupling 20 are engaged with each other, the cams 19 to rotate in synchronism with the print drum 5.

Tension springs 21 each are anchored at one end to the other end of associated one of the press roller arms 14 and at the other end to the support member 15, constantly biasing the press roller arms 14 clockwise, as viewed in FIG. 1, about the shaft 16. This allows the cam followers 17 to contact projections included in the respective cams 19. In this configuration, when the projections of the cams 19 are brought into contact with the cam followers 17, the press roller arms 14 are angularly moved counterclockwise, as viewed in FIG. 1, against the action of the tension springs 21, moving the press roller 6 away from the print drum 5. When the projections of the cams 19 are then brought out of contact with the cam followers 17, the press roller arms 14 are angularly moved clockwise, as viewed in FIG. 1, under the action of the springs 21, pressing the press roller 6 against the print drum 5. At this instant, a preselected gap is formed between each cam 19 and the cam follower 17 associated therewith.

The press roller arms 14, shaft 16, cam followers 17, cams 19, cam shaft 19*a*, pin 19*b*, coupling 20 and tension springs 21 constitute moving means 22 for selectively moving the press roller 6 into or out of contact with the print drum 5. The moving means 22 is operated to move the press roller 6 between a released position where the press roller 6 is released from the print drum 5, FIG. 1, and a contact position where the former is pressed against the latter by preselected pressure.

The master making section 3 is arranged at the upper left of the printing section 2 and includes stencil storing means 24, a thermal head 25, a platen roller 26, master cutting means 27 and a roller pair 28 for conveyance. The stencil storing means 24 is adapted to support a stencil roll 29*a* such that the stencil roll 29*a* is freely rotatable and dismountable.

The thermal head 25, including a number of heat generating devices, is supported by side walls, not shown, included in the master making section 3 and has a heat generating surface constantly pressed against the platen roller 26 by biasing means not shown. The platen roller 26 is rotatably supported by the side walls of the master making section 3 and rotated by a stepping motor not shown.

The master cutting means 27 includes a stationary edge affixed to the master making section 3 and a movable edge movable relative to the stationary edge. The movable edge is moved relative to the stationary edge by being rotated or moved in the up-and-down direction to thereby cut a stencil 29 at a preselected length and produce a master therefrom. The roller pair 28 is made up of a drive roller rotated by drive means, not shown, and a driven roller pressed against the drive roller so as to be rotated thereby. The drive roller and driven roller cooperate to convey the master made by the thermal head 25 and platen roller 26 toward the printing section 2.

The sheet discharging section 4 is arranged below the master making section 3 and mainly constituted by a peeler 30, a peel fan 31, a sheet conveyor 32 and a print tray 33. The peeler 30 is angularly movably supported by the side walls of the printer body at its base end and driven by peeler drive means, not shown, such that the end having an acute angle is selectively movable toward or away from the circumferential surface of the print drum 5. The peel fan 31 is mounted on the printer body 23 and adapted to send air toward the position where the peeler 30 and print drum 5 adjoin each other. The peeler 30 and peel fan 31 cooperate to peel off a sheet carrying an image thereon, i.e., a print from the circumference of the print drum 5.

The sheet conveyor 32 is positioned below the peeler 30 and provided with a conventional configuration including a drive roller, a driven roller, a plurality of parallel, endless belts formed with holes therein each and passed over the drive roller and driven roller, and a suction fan. The endless belts convey a sheet to the left, as viewed in FIG. 1, while the suction fan retains the sheet on the belts.

The print tray 33 is positioned at the left-hand side of the conveyer 32 and includes a single end fence 33*a* and a pair of side fences not shown. The end fence 33*a* is movable in the direction of sheet conveyance while the side fences are selectively movable toward or away from each other in the widthwise direction of a sheet, neatly positioning sheets, or prints, sequentially stacked on the print tray 33.

The sheet feeding section mentioned earlier is located at the lower right of the printing section 2, although not shown specifically, and adapted to feed sheets to the printing section 2 one by one. The sheet feeding section includes a sheet tray, a pickup roller, sheet separating means and a registration roller pair 34. The pickup roller and sheet separating means are configured to pay out top one of a number of sheets stacked on the sheet tray while separating it from underlying sheets. The registration roller pair 34 is provided with a conventional configuration for stopping the sheet paid out from the print tray and then driving it toward the printing section 2 by being rotated at preselected timing such that the sheet meets an image formed in the master, which is also designated by the reference numeral 29.

A master discharging section, not shown, is arranged at the upper right of the printing section 2 and adapted for peeling off a used master from the print drum 5 and discarding it. The master discharging section includes a discharge roller pair, waste master box and a compression plate. The discharge roller pair picks up the edge of a used master away from the surface of the print drum 5 and conveys it to the waste master box. Thereafter, the compression plate compresses the used master dropped into the waste master box. Such a configuration of the master discharging section is also conventional.

The stencil printer 1 in accordance with the illustrative embodiment will be operated, as follows.

The operator of the stencil printer 1 sets a desired document on an image scanning section, not shown, positioned on the top of the printer body 23 and then pushes a cut or perforation start key provided on a control panel not shown. In response, the document scanning section scans or reads the document while the master discharging section peels off a used master from the print drum 5. Subsequently, the print drum 5 is rotated to a position where the clamper 8 is located substantially at the top and then stopped there. Thereafter, the clamper 8 is opened by opening/closing means not shown. In this condition, the stencil printer 1 awaits arrival of a master. This is followed by a master making operation.

The master making operation begins with causing the stepping motor and drive means to rotate the platen roller 26 and roller pair 28 for thereby paying out the stencil 29 from the stencil roll 29*a*. The stencil 29 thus paid out is selectively perforated, or cut, by the heat generating devices of the thermal head 25 while being conveyed via the thermal head 25, so that an image is formed in the stencil 29 in accordance with image data. The stencil 29 with the image is then conveyed by the platen roller 26 and roller pair 28 toward the clamper 8 held in the open position on the print drum 5.

When the leading edge of the stencil 29 is brought to a preselected position between the stage 7 and the clamper 8, as determined by control means, not shown, in terms of the number of steps of the stepping motor, the opening/closing means closes the clamper 8 in order to retain the leading edge of the stencil 29 on the print drum 5. Subsequently, the print drum 5 is driven to rotate clockwise, as viewed in FIG. 1, at a peripheral speed identical with the stencil conveying speed, so that the stencil 29 is wrapped round the print drum 5. When the stencil 29 is wrapped round the print drum 29 by a length corresponding to a single master, as also determined by the control means in terms of the number of steps of the stepping motor, the platen roller 26 and roller pair 28 are caused stop rotating while the cutting means 27 is driven to cut off the master 29 from the stencil 29. Thereafter, the master 29 is pulled out from the master making section 3 by the print drum 5, which is in rotation. As soon as the print drum 5 is again rotated to its home position, it is brought to a stop. This is the end of a master making and wrapping operation.

The master making and wrapping operation stated above is followed by a master adhering operation. More specifically, the print drum 5 is caused to start rotating at a low speed while a single sheet is fed from the sheet feeding section and nipped by the registration roller pair 34. The registration roller pair 34 is again driven at a timing when the leading edge of an image formed in the master 29 reaches a position where it faces the press roller 6. Just after the above timing, the larger diameter portions of the cams 19 move away from the cam followers 17 with the result that the press roller arms 14 are angularly moved under the action of the tension springs 21, pressing the press roller or pressing member 6 against the outer periphery of the print drum 5 via the master 29. As a result, the ink applied to the inner periphery of the print drum 5 by the ink roller 11 is transferred to the sheet via the porous portion of the print drum 5, mesh screen and perforations formed in the master 29, causing the master 29 to adhere to the print drum 5.

The sheet with the ink transferred thereto, as stated above, is peeled off from the print drum 5 by the peeler 30 and peel fan 31, dropped and then conveyed to the print tray 33 by the sheet conveyor 32. In this condition, the stencil printer 1 remains in a stand-by state.

When the operator presses a trial print key, not shown, also provided on the control panel, the print drum 5 is rotated at a higher speed than during the master adhering operation while another sheet is fed from the sheet feeding section. This sheet, like the previous sheet, is pressed against the print drum 5 by the press roller 6, peeled off from the print drum 5 and then driven out to the print tray 33 as a trial print.

The operator then checks the density, position and so forth of an image printed on the trial print, adjusts such factors on various keys arranged on the control panel, produces another trial print, sets a desired number of prints and a desired print speed, and then pushes a print start key on the control panel. In response, the print drum 5 is driven at a peripheral speed corresponding to the desired print speed while sheets are fed from the sheet feeding section one by one. As soon as the desired number of prints are produced, the print drum 5 is stopped at the home position. In this condition, the stencil printer 1 again remains in the stand-by state.

Assume that a jam occurs during the above master adhering, trial printing or actual printing operation, e.g., a sheet conveyed by the registration roller pair 34 gets under or wraps round the press roller 6. Then, in response to information output from a sensor, not shown, the operation of the stencil printer 1 is stopped as soon as the print drum 5 is brought to a position where the clamper 8 is located substantially at the bottom. At this instant, the cams 19 are held in contact with the cam followers 17, holding the press roller 6 in the released position.

Subsequently, the operator unlocks the support member 15 from the printer body 23 by operating a locking device, pulls out the support member 15 toward the operator along the guide members 18, and then removes the jamming sheet. The operator then returns the support member 15 to a preselected position in the printer body 23 and again locks the former to the latter. Thereafter, if the printing operation has been interrupted halfway, remaining part of the printing operation is effected. If desired, the support member 15 may be automatically mounted to or dismounted from the printer body 23 by use of a lead screw or a motor by way of example. Also, the support member 15 may be provided with holding means for holding the press roller in the released position.

As stated above, in the illustrative embodiment, a sheet, jamming any position around the press roller 6, can be removed after the support member 15 with the press roller 6 has been pulled out from the printer body 23 and therefore efficiently in a broad space outside of the printer body 23. In addition, such a support member 15 noticeably improves the efficient replacement of the press roller 6 and the efficient replacement or adjustment of any other part mounted on the support member 15.

Figure 4:
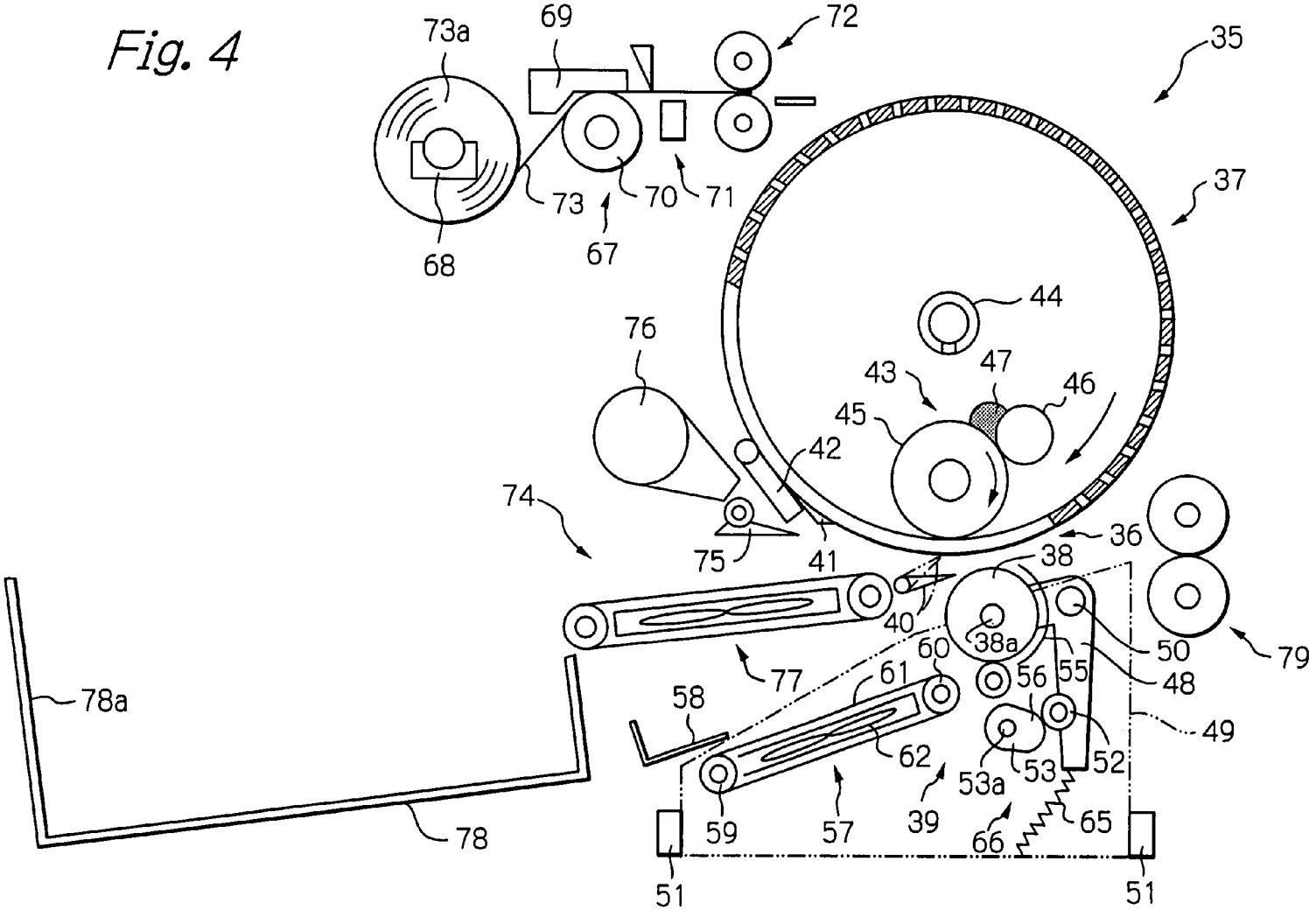
FIG. 4 is a front view showing the general construction of a second embodiment of the stencil printer in accordance with the present invention.

Reference will be made to FIG. 4 for describing a second embodiment of the stencil printer in accordance with the present invention configured to implement the single step, duplex printing stated earlier. Because the configuration of the second embodiment is related to the configuration of the duplex printer taught in Laid-Open Publication No. 2005-125716 discussed previously, the description of various sections will be simplified as far as possible.

A printing section 36, positioned at substantially the center of a printer body or casing, not shown, includes a print drum 37, a press roller or pressing means 38, refeeding means 39 and a path selector 40. The print drum 37, like the print drum 5, is generally made up of a porous support plate affixed at opposite edges thereof to the circumferential surfaces of a pair of end plates, not shown, and a mesh screen wrapped round the support plate in a plurality of layers. A stage 41 is positioned on the non-porous portion of the porous support plate while a clamper 42 is mounted on the stage 41 in such a manner as to be openable about a shaft away from the stage 41. The clamper 42 is opened and closed by opening/closing means, not shown, when the print drum 37 is rotated to a preselected position.

Ink feeding means 43, similar to the ink feeding means 9, is arranged inside the print drum 37 and includes an ink feed pipe 44, playing the role of a print drum shaft at the same time, an ink roller 45 and a doctor roller 46. The doctor roller 46 is positioned in the vicinity of the ink roller 45. The ink roller 45 and doctor roller 46 are spaced from each other by a small gap. A space with a generally wedge-shaped cross-section is formed at a position where the ink roller 45 and doctor roller 46 adjoin each other, forming an ink well 47. The ink is fed from the ink well 47 to the inner periphery of the print drum 37 via the ink roller 45.

Figure 5:
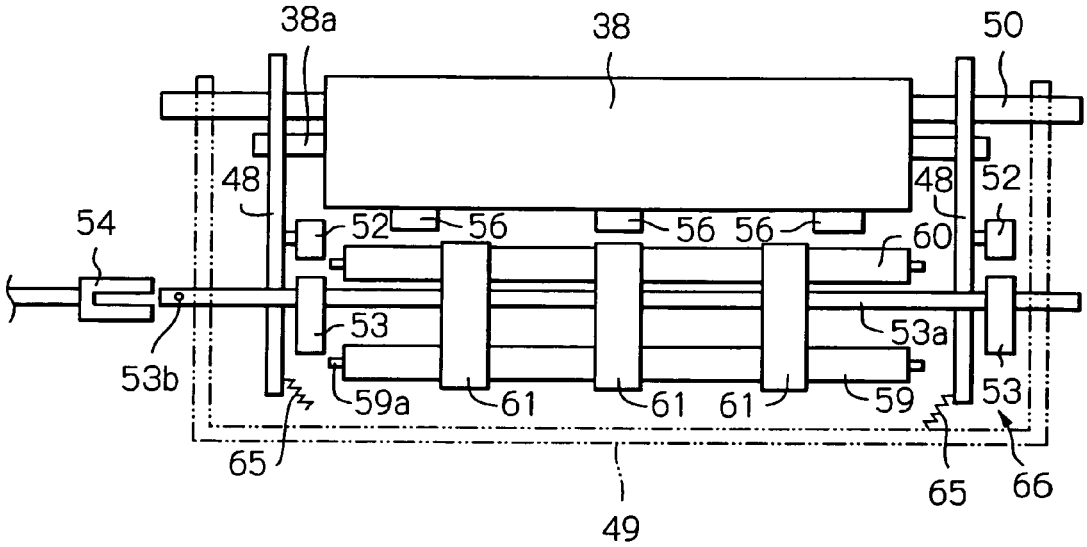
FIGS. 5 and 6 are views showing a mechanism supporting a press roller and refeeding means included in the second embodiment.

The press roller or pressing member 38 is positioned below the print drum 37 and configured in the same manner as a press roller 21 taught in Laid-Open Publication No. 2005-125716. More specifically, as shown in FIG. 5, the press roller 38 whose surface is covered with fine grains of glass, ceramics or the like includes a shaft portion 38*a* rotatably supported at opposite ends thereof by one end of a pair of press roller arms 48, which are configured in the same manner as the press roller arms 14. The press roller 38 is caused to rotate by a drive motor, not shown, as taught in Laid-Open Publication No. 2005-125716. Each press roller arm or flat plate-like member 48 is rotatably supported at its bent portion by a shaft 50 mounted on a support member 49. The support member 49 is mounted on the printer body such that it can be pulled out of the printer body along rails or similar guide members 51 and is usually locked to the printer body by a locking device, not shown.

Cam followers 52 each are rotatably mounted on the other end portion of the respective press roller arm 48. Two cam groups 53 are affixed to a cam shaft 53*a*, which is rotatably supported by the support member 49, in the vicinity of the cam followers 52. A pin 53*b* is passed through one end of the cam shaft 53*a*. A coupling 54, see FIG. 5, is mounted on the printer body and brought into engagement with the pin 53*b* when the support member 49 is mounted to the printer body. Torque output from print drum drive means, not shown, is transferred to the coupling 54, so that the cam groups 53 are rotated in synchronism with the print drum 37 when the pin 54 and coupling 53*b* are engaged with each other.

Each cam group 53, like print pressure range varying means 28 taught in Laid-Open Publication No. 2005-125716, includes a plurality of cam plates and is configured to selectively open or close the cam plates to vary the contact range thereof with the associated cam follower 52 and therefore the contact range of the press roller 38 with the print drum 37. More specifically, the press roller 38 is selectively caused to contact the print drum 37 over a first range corresponding to the area of a first image formed in a divided master, which will be described later specifically, the area of a second range corresponding to the area of a second image or a third range corresponding to the total area of the first and second images.

Tension springs 65 each are anchored at one end to the respective press roller arm 48 and at the other end to the support member 49, constantly biasing the press roller arms 48 clockwise, as viewed in FIG. 4, about the shaft 50. This allows the cam followers 52 to selectively contact the projections of the cams constituting the cam groups 53. When the projections of the cam plates are brought into contact with the cam followers 52, the press roller arms 48 are angularly moved counterclockwise, as viewed in FIG. 4, against the action of the tension springs 65, releasing the press roller 38 from the print drum 37. When the above projections of the cam plates are brought out of contact with the cam followers 52, the press roller arms 48 are angularly moved clockwise, as viewed in FIG. 4, under the action of the tension springs 65, pressing the press roller 38 against the print drum 37. A preselected gap is formed between the cam plates and the cam followers 52 when the pres roller 38 is pressed against the print drum 37.

In the above configuration, the press roller arms 48, shaft 50, cam followers 52, cam groups 53, cam shaft 53*a*, pin 53*b*, coupling 54 and tension springs 65 constitute moving means 66 for moving the press roller 38 into or out of contact with the print drum 37. Thus, the press roller 38 is movable between a released position where it is spaced from the print drum 37, as shown in FIG. 4, and a contact position where the former is pressed against the latter by preselected pressure.

A roller guide plate 55 and refeed rollers 56, similar to a roller guide plate 50 and refeed rollers 51 taught in Laid-Open Publication No. 2005-125716, are positioned between the press roller arms 48 in the vicinity of the press roller 38. The roller guide plate 55 is fixed in place between the press roller arms 48 at a preselected distance from the press roller while the refeed rollers 56 are rotatably supported between the press roller arms 48 in pressing contact with the bottom portion of the press roller 38.

A refeed conveyor 57 and a movable guide 58, similar to a refeeding device 104 and a guide 81 taught in Laid-Open Publication No. 2005-125716, are located at the lower left of the press roller 38 in FIG. 4.

Figure 6:
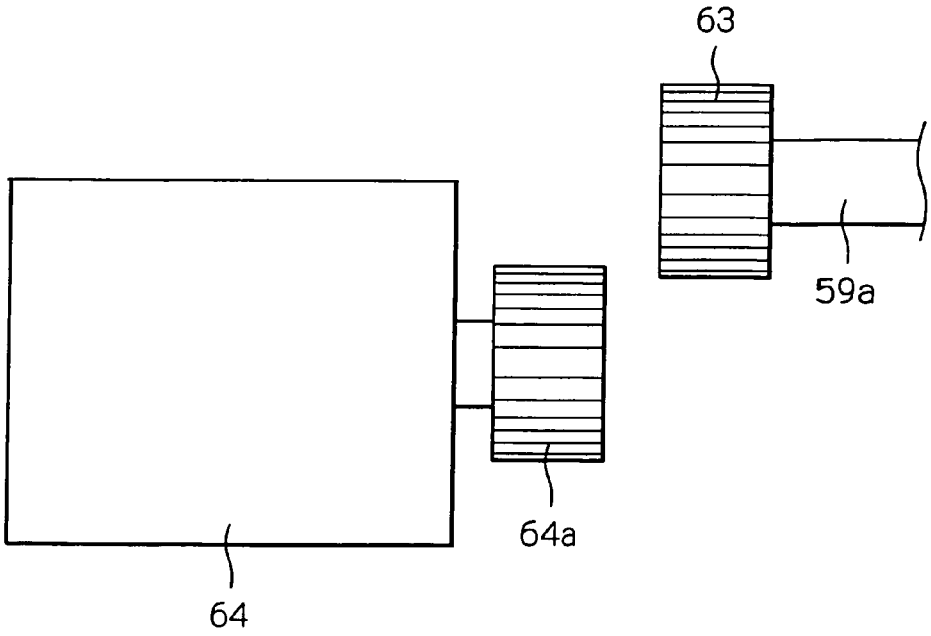

The refeed conveyor 57 is comprised of a drive roller 59, a driven roller 60, a plurality of parallel endless belts 61 passed over the drive roller 59 and driven roller 60 and a suction fan 62 and has its end at the driven roller 60 side angularly movably supported. The drive roller 59 includes a shaft 59*a* rotatably supported by the support member 49. As shown in FIG. 6, a drive gear 63 is affixed to one end of the shaft 59*a* protruding from the support member 49. The drive gear 63 is configured to mesh with a pinion 64*a* mounted on the output shaft of a drive motor 64, which is mounted on the printer body, when the support member 49 is mounted to the printer body. In this condition, when the drive motor 64 is energized, it causes the refeed conveyor 57 to operate via the pinion 64*a* and drive gear 63.

The movable guide 58 is supported by the printer body above the refeed conveyor 57 and driven by drive means, not shown, to move back and forth between a first position close to the circumference of the press roller 38 and a second position, FIG. 4, remote from the same. The movable guide 58 nips the leading edge of a sheet carrying an image on one surface, i.e., a simplex print when moved to the first position and then releases it when moved to the second position.

The roller guide plate 55, refeed rollers 56, refeed conveyor 57, guide 58 and drive motor 64 constitute the refeeding means 39 adapted for feeding a simplex print coming out of the printing section 36 again to the printing section 36.

The path selector 40 is positioned above the refeed conveyor 57 at the left-hand side of the press roller 38, as viewed in FIG. 4, and angularly movably supported by the printer body at its base end. The path selector 40 is moved by a solenoid, motor or similar actuator such that its edge having an acute angle is selectively positioned at a first position, indicated by a solid like in FIG. 4, where the edge is remote from the print drum 37 or a second position, indicated by a phantom line in FIG. 4, where the former is close to the latter. The path selector 40 steers, in the first position, a sheet coming out of the printing section 36 toward a sheet discharging section 74, which will be described specifically later, or steers it, in the second position, toward the refeed conveyor 57.

A master making section 67 is arranged at the upper left of the print drum 37 and includes stencil storing means 68, a thermal head 69, a platen roller 70, master cutting means 71 and a roller pair 72 for conveyance. The stencil storing means 68 is adapted to support a stencil roll 73*a* such that the stencil roll 73*a* is freely rotatable and dismountable.

The thermal head 69, including a number of heat generating devices, is supported by side walls, not shown, included in the master making section 67 and has a heat generating surface constantly pressed against the platen roller 70 by biasing means not shown. The platen roller 70 is rotatably supported by the side walls of the master making section 67 and rotated by a stepping motor not shown.

The master cutting means 71 includes a stationary edge affixed to the master making section 67 and a movable edge movable relative to the stationary edge. The movable edge is moved relative to the stationary edge by being rotated or moved in the up-and-down direction to thereby cut a stencil 73 at a preselected length and produce a master therefrom. The roller pair 72 is made up of a drive roller rotated by drive means, not shown, and a driven roller pressed against the drive roller so as to be rotated thereby. The drive roller and driven roller cooperate to convey the master made by the thermal head 69 and platen roller 70 toward the printing section 36.

The master making section 67 with the above configuration selectively makes a master 73 for simplex printing formed with a single image or a divided master 73 for duplex printing formed with a first and a second image side by side. In the illustrative embodiment, the maximum print size available with the print drum 37 is assumed to be A3, so that the maximum size of an image to be formed in the master 73 for simplex printing is A3 while the maximum size of each of the first and second images to be formed in the divided master 73 is A4.

A sheet discharging section 74 is arranged below the master making section 67 and includes a peeler 75, a peel fan 76, a sheet conveyor 77 and a print tray 78. The peeler 75 is angularly movably supported by the side walls of the printer body at its base end and driven by peeler drive means, not shown, such that the end having an acute angle is selectively movable toward or away from the circumferential surface of the print drum 37. The peel fan 76 is mounted on the printer body and adapted to send air toward the position where the peeler 75 and print drum 37 adjoin each other. The peeler 75 and peel fan 76 cooperate to peel off a sheet carrying an image thereon, i.e., a print from the circumference of the print drum 37.

The sheet conveyor 77 is positioned below the peeler 75 and provided with a conventional configuration including a drive roller, a driven roller, a plurality of parallel, endless belts passed over the drive roller and driven roller and formed with holes, and a suction fan. A sheet or print is conveyed by the endless belts to the left, as viewed in FIG. 4, while being retained thereon by the suction fan.

A print tray 78 is positioned at the left-hand side of the conveyer 77 and includes a single end fence 78*a* and a pair of side fences not shown. The end fence 78*a* is movable in the direction of sheet conveyance while the side fences are selectively movable toward or away from each other in the widthwise direction of a sheet, neatly positioning sheets, or prints, sequentially stacked on the print tray 33.

The sheet feeding section mentioned earlier is located at the lower right of the printing section 36, although not shown specifically, and adapted to feed sheets to the printing section 36 one by one. The sheet feeding section includes a sheet tray, a pickup roller, sheet separating means and a registration roller pair 79. The pickup roller and sheet separating means are configured to pay out top one of a number of sheets stacked on the sheet tray while separating it from underlying sheets. The registration roller pair 79 is provided with a conventional configuration for stopping the sheet paid out from the print tray and then driving it toward the printing section 36 by being rotated at preselected timing such that the sheet meets an image formed in the master 73.

A master discharging section, not shown, is arranged at the upper right of the printing section 36 and adapted for peeling off a used master from the print drum 37 and discarding it. The master discharging section includes a discharge roller pair, waste master box and a compression plate. The discharge roller pair picks up the edge of a used master away from the surface of the print drum 37 and conveys it to the waste master box. Thereafter, the compression plate compresses the used master dropped into the waste master box. Such a configuration of the master discharging section is also conventional.

The operation of the stencil printer 35 in accordance with the illustrative embodiment will be described hereinafter. The stencil printer 35 is operable in either one of a simplex print mode and a duplex print mode as selected on a control panel, not shown, by the operator of the printer 35. A simplex print mode operation will not be described specifically because it is identical with the operation of the stencil printer 1, FIG. 1, executed after the peeler 40 has been moved to the first position.

Assume that the operator, selected the duplex print mode, sets two documents on an image scanning section, not shown, provided on the top of the printer body and then pushes a perforation start key positioned on the control panel. Then, the document scanning section reads the two documents one by one while the master discharging section peels off a used master from the print drum 37 and discards it. Subsequently, the print drum 37 is rotated to its home position where the clamper 42 is located substantially at the top and then stopped there. Thereafter, the clamper 42 is opened by opening/closing means not shown. In this condition, the stencil printer 35 awaits arrival of a master. This is followed by a master making operation.

The master making operation begins with causing the stepping motor and drive means to rotate the platen roller 70 and roller pair 72 for thereby paying out the stencil 73 from the stencil roll 73*a*. The stencil 73 thus paid out is selectively perforated, or cut, by the heat generating devices of the thermal head 69 while being conveyed via the thermal head 69, so that a first and a second image are formed in the stencil 73. The stencil 73 with the first and second images is then conveyed by the platen roller 70 and roller pair 72 toward the clamper 42 held in the open position on the print drum 37.

When the leading edge of the stencil 73 is brought to a preselected position between the stage 41 and the clamper 42, as determined by control means not shown, in terms of the number of steps of the stepping motor, the opening/closing means closes the clamper 42 in order to retain the leading edge of the stencil 73 on the print drum 37. Subsequently, the print drum 37 is driven to rotate clockwise, as viewed in FIG. 4, at a peripheral speed identical with the stencil conveying speed, so that the stencil 73 is wrapped round the print drum 37. When the stencil 73 is wrapped round the print drum 29 by a length corresponding to a single master, as also determined by the control means in terms of the number of steps of the stepping motor, the platen roller 70 and roller pair 72 are caused to stop rotating while the cutting means 71 is driven to cut off the divided master 73 from the stencil 73. Thereafter, the divided master 73 is pulled out from the master making section 67 by the print drum 37, which is in rotation. As soon as the print drum 37 is again rotated to its home position, it is brought to a stop. This is the end of a master making and wrapping operation.

The master making and wrapping operation stated above is followed by a master adhering operation. More specifically, the print drum 37 is caused to start rotating at a low speed while a single sheet is fed from the sheet feeding section and nipped by the registration roller pair 79. The registration roller pair 79 is again driven at a timing when the leading edge of the first image formed in the master 73 reaches a position where it faces the press roller 38. At this instant, among the cam plates constituting the cam groups 53, cam plates that cause the press roller 38 to contact the print drum 37 over the first range are selected while the path selector 40 is located at the second position. Just after the rotation of the registration roller pair 79, the larger diameter portions of the above cam plates move away from the can followers 52 with the result that the press roller arms 48 are angularly moved under the action of the tension springs 56, pressing the press roller 38 against the outer periphery of the print drum 37 via the divided master 73. As a result, the ink applied to the inner periphery of the print drum 37 by the ink roller 46 is transferred to the sheet via the porous portion of the print drum 37, mesh screen and perforations formed in the first image of the divided master 73, causing the master 73 to adhere to the print drum 37.

The sheet with the ink transferred thereto, as stated above, is peeled off from the print drum 37 by the path selector 40 held in the second position and dropped and then has its leading edge nipped by the movable guide 58 held in the first position. Subsequently, the movable guide 58 is moved to the second position at the sheet conveying speed, i.e., the peripheral speed of the print drum 37 and press roller 38, temporarily storing the sheet or simplex print on the top of the refeed conveyor 57.

Before the print drum 37 is caused to complete one full rotation to bring the leading edge of the second image of the divided master 73 to a position where it faces the press roller 38, the refeed conveyor 57 is operated to again feed the sheet temporarily stored to the gap between the press roller 38 and the refeed conveyor 57. The sheet is then conveyed by the press roller 38 along the circumference of the press roller 38 while being guided by the roller guide plate 55 and is again brought to the gap between the print drum 37 and the press roller 38. At this instant, among the cam plates of the cam groups 53, cam plates that cause the press roller 38 to contact the print drum 37 over the second range are selected while the path selector 40 is switched from the second position to the first position. After the operation of the refeed conveyor 57, the lager diameter portions of the above cam plates move away from the cam followers 52 with the result that the press roller arms 48 are angularly moved under the action of the tension springs 65, again causing the press roller 38 to contact the print drum 37.

When the press roller 38 is again pressed against the print drum 37, as stated above, the ink applied to the inner periphery of the print drum 37 by the ink roller 45 is transferred to the sheet via the porous portion of the print drum 37, mesh screen and perforations forming the second image of the master 73, causing the second image to adhere to the print drum 37. Subsequently, the sheet thus carrying the ink on the reverse surface thereof, i.e., duplex print is steered to the sheet discharging section 74 by the path selector 40, which is held in the first position this time, peeled off from the print drum 37 by the peeler 75 and peel fan 76, dropped and then driven out to the print tray 78 by the conveyor 77. In this condition, the stencil printer 35 remains in the stand-by condition.

When the operator presses a trial print key, not shown, also provided on the control panel, the print drum 37 is rotated at a higher speed than during the master adhering operation while another sheet is fed from the sheet feeding section. This sheet, like the previous sheet, is pressed against the print drum 37 by the press roller 38, peeled off from the print drum 37 and then steered to the refeed conveyor 57 as a simplex print. Subsequently, the sheet is again fed by the refeeding device to the gap between the print drum 37 and the press roller 38 and then driven out to the print tray 78 as a duplex trial print.

The operator then checks the density, position and so forth of each image printed on the trial print, adjusts such factors on various keys arranged on the control panel, produces another trial print, sets a desired number of prints and a desired print speed, and then pushes a print start key on the control panel. In response, the print drum 37 is driven at a peripheral speed corresponding to the desired print speed while sheets are fed from the sheet feeding section one by one. At this time, after the first sheet has been steered to the refeed conveyor 57, cam plates included in the cam groups 53 and allowing the press roller 38 to contact the print drum 37 over the third range are selected. Consequently, the second sheet, like the first sheet, is conveyed to the refeed conveyor 57 while the first sheet is again fed from the refeed conveyor 57 to the printing section 36.

Just before the trailing edge of the second sheet arrives at the path selector 40, the path selector 40 is switched from the second position to the first position for steering the first sheet carrying the second image thereon, i.e., duplex print toward the print tray 78 via the sheet discharging section. Just after the trailing edge of the first sheet, the path selector 40 is returned from the first position to the second position. Subsequently, a third sheet is fed from the sheet feeding section, so that the first image is transferred to the third sheet. The procedure described so far is repeated thereafter.

After the last sheet, carrying the first image thereon, has been guided to the refeed conveyor 57, the cam plates of the cam groups 53 that set up the second contact range of the press roller 38 with the print drum 37 are selected. Consequently, after the second image has been transferred to the reverse surface of the last sheet, the sheet is guided by the path selector 40 to the sheet discharging section 74 and then stacked on the print tray 78. Thereafter, the stencil printer 35 again remains in the stand-by position with the print drum 37 being held in the home position.

Assume that a jam occurs during the above master adhering, trial printing or actual printing operation, e.g., a sheet conveyed by the registration roller pair 79 or the refeeding means 39 gets under or wraps round the press roller 38. Then, in response to information output from a sensor, not shown, the operation of the stencil printer 35 is stopped as soon as the print drum 37 is brought to a position where the clamper 42 is located substantially at the bottom. At this instant, the larger diameter portions of any of the cams included in the cam groups 53 are held in contact with the cam followers 52, holding the press roller 38 in the released position.

Subsequently, the operator unlocks the support member 49 from the printer body by operating a locking device, pulls out the support member 49 toward the operator along the guide members 51, and then removes the jamming sheet. The operator then returns the support member 49 to a preselected position in the printer body and again locks the former to the latter. Thereafter, if the printing operation has been interrupted halfway, remaining part of the printing operation is effected. If desired, the support member 49 may be automatically mounted to or dismounted from the printer body by use of a lead screw or a motor by way of example. Also, the support member 49 may be provided with holding means for holding the press roller 38 in the released position.

As stated above, in the illustrative embodiment, a sheet, jamming any position around the press roller 38 or the refeeding means 39, can be removed after the support member 49 with the press roller 38 and refeeding means 39 has been pulled out from the printer body and therefore efficiently in a broad space outside of the printer body. In addition, it is possible to noticeably enhance the efficiency of replacement of the press roller 38 or the efficiency of replacement or adjustment of the refeeding means 39 and other parts mounted on the support member 49.

Figure 7:
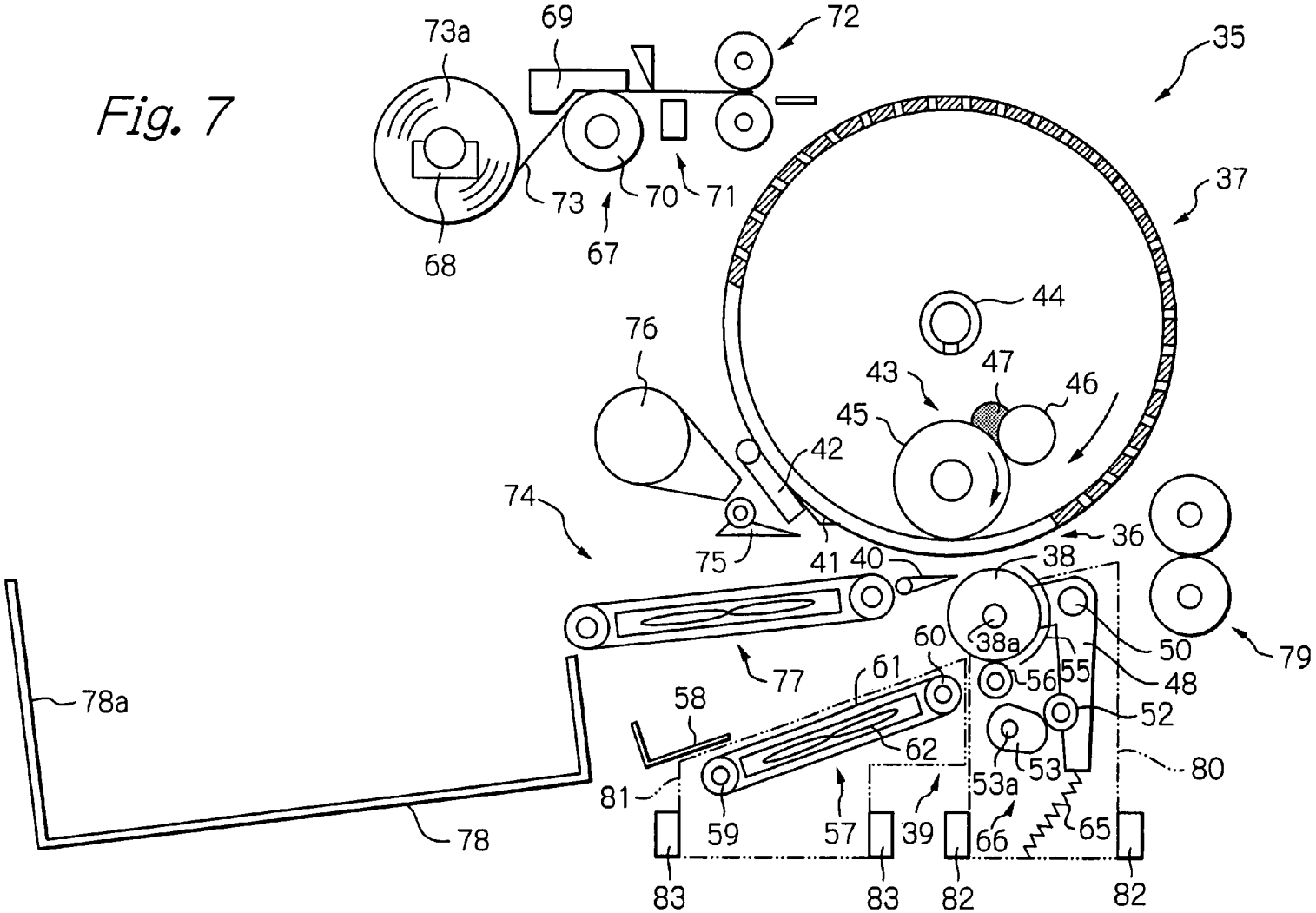
FIG. 7 is a front view showing the general construction of a third embodiment of the stencil printer in accordance with the present invention.

FIG. 7 shows a third embodiment of the stencil printer in accordance with the present invention. As shown, the third embodiment is identical with the second embodiment except that the support member 49 is replaced with a first and a second support members 80 and 81 and in that the refeed conveyor 57 is supported by the support member 81 in such a manner as to be angularly movable about and removable from the support member 81. In FIG. 7, structural elements identical with those shown in FIG. 4 are designated by identical reference numerals, and detailed description thereof will not be made in order to avoid redundancy.

The first support member 80 and second support member 81 support the press roller arms 48 and cam groups 53 and the refeed conveyor 57, respectively. The support member 80 can be freely pulled out from the printer body along rails or similar guide members 82 mounted on the printer body. Likewise, the support member 81 can be pulled out from the printer body along rails or similar guide members 83 similar to the guide members 82. Usually, the support members 80 and 81 each are locked to the printer body by a respective locking device.

With the above construction, the third embodiment achieves the same advantages as the second embodiment. In addition, in the third embodiment, the press roller 38 and moving means 66 and the refeed conveyor 57 can be pulled out from the printer body independently of each other, promoting efficient removal of a jamming sheet or efficient replacement or maintenance.

In the first embodiment, the support member 15 is configured such that it can be pulled out from the printer body 23. Likewise, in the second and third embodiments, the support members 49 and 80 and 81, respectively, are configured such that they can be pulled out from the printer body not shown. Alternatively, the support member 15, 49, 80 and 81 each can be configured to be bodily removable from the associated printer body in order to make, e.g., the replacement of various parts more efficient.

Figure 8:
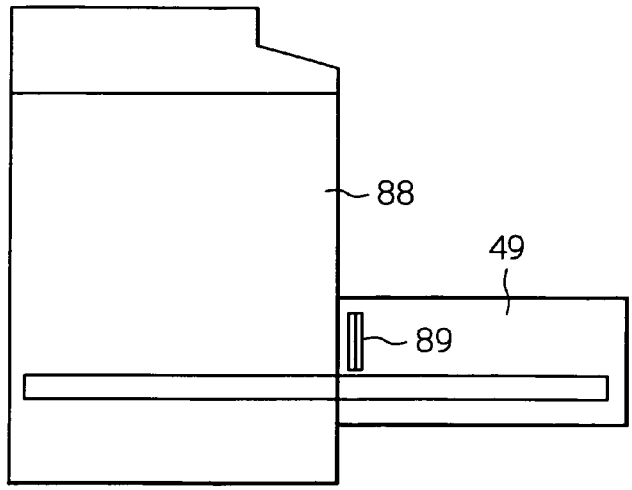
FIG. 8 is a side elevation showing a fourth embodiment of the stencil printer in accordance with the present invention.

A fourth embodiment of the stencil printer in accordance with the present invention will be described with reference to FIG. 8. The fourth embodiment is generally identical with the second embodiment except that a printer body 88 is substituted for the printer body, not shown, that the support member 49 can be pulled out from the printer body 88, and that a discharge member 89 is provided on the support member 49 for discharging, when the support member 49 is pulled out from the printer body 88, a sheet laid on the refeed conveyor 57 to the outside of the printer body 88 together with the refeed conveyor 57.

Figure 9:
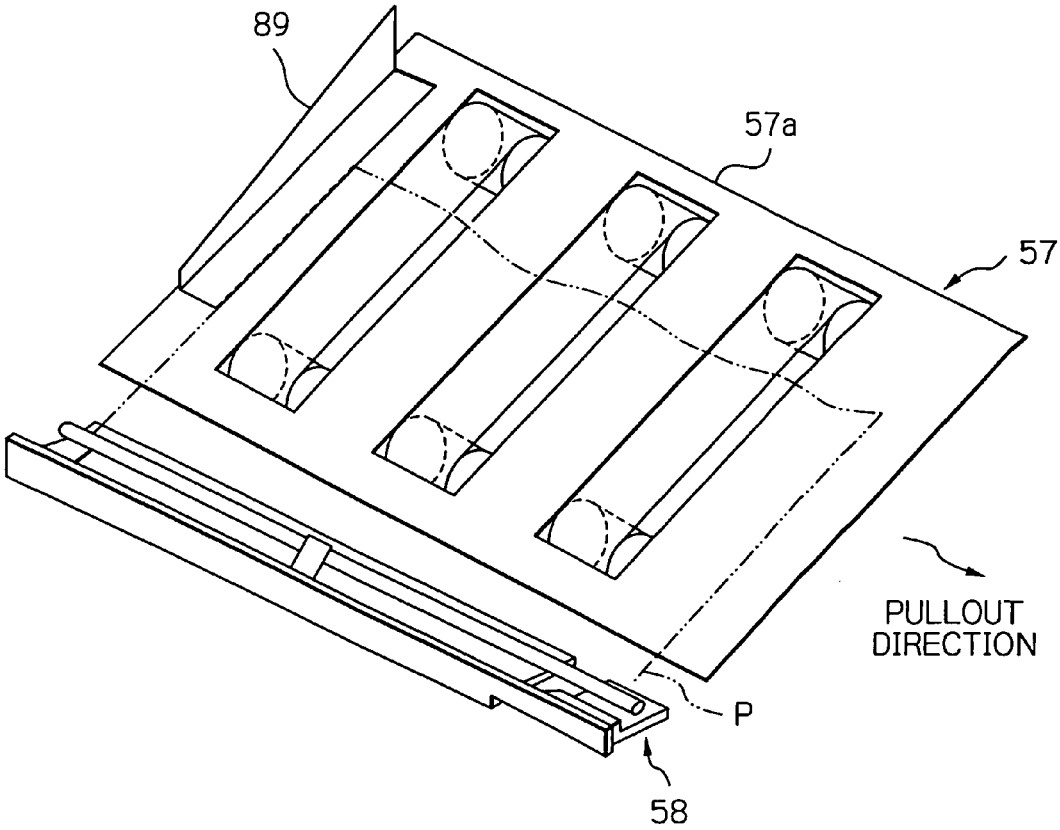
FIG. 9 is a perspective view showing a discharge member included in the fourth embodiment.

More specifically, as shown in FIG. 9, the discharge member 89 is implemented by a plate having a generally L-shaped section as seen in a cross-section; the upright portion of "L" decreases in height toward the downstream side in the direction of sheet conveyance. The discharge member 89 is affixed to the deepest side of a top plate 57*a*, which forms part of the refeed conveyor 57, so as not to interfere with a sheet P being conveyed by the refeed conveyor 57 when the stencil printer is in operation.

Figure 10:
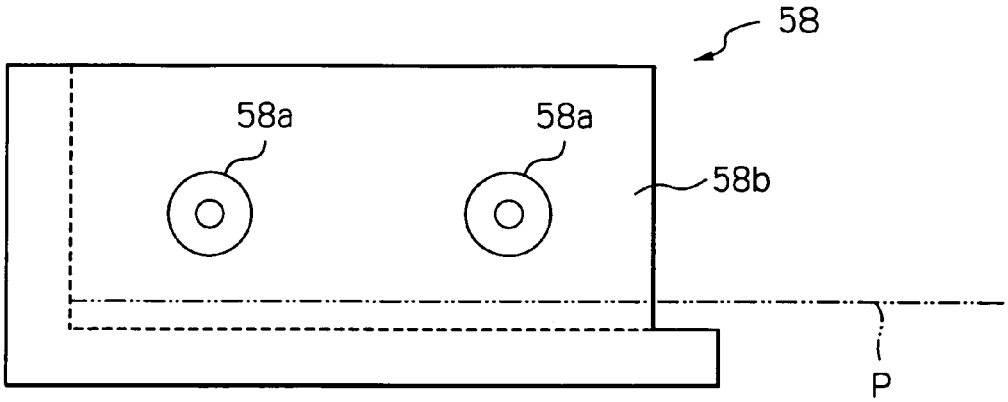
Fig. 10 PRIOR ART
FIG. 10 is a view showing a conventional movable guide.

The movable guide 58 is positioned downstream of the refeed conveyor 57 in the direction of sheet conveyance in order to nip the leading edge of a sheet carrying an image on one surface thereof, i.e., a simplex print coming out of the printing section 36, as stated previously. FIG. 10 shows a conventional movable guide 58 similar to a movable guide 81 taught in Laid-Open Publication No. 2005-125716. As shown, the movable guide 58 includes a pair of side plates 58*b* (only one is visible) on which rollers 58*a* are rotatably mounted and supported by rails not shown, mounted on the printer body 88. So long as the leading edge of a sheet P laid on the refeed conveyor 58 is positioned on the movable guide 58, the leading edge of the sheet P is left on the movable guide 58 disposed in the printer body even if the support member 49 is pulled out from the printer body 88, resulting in a sheet jam.

Figure 11:
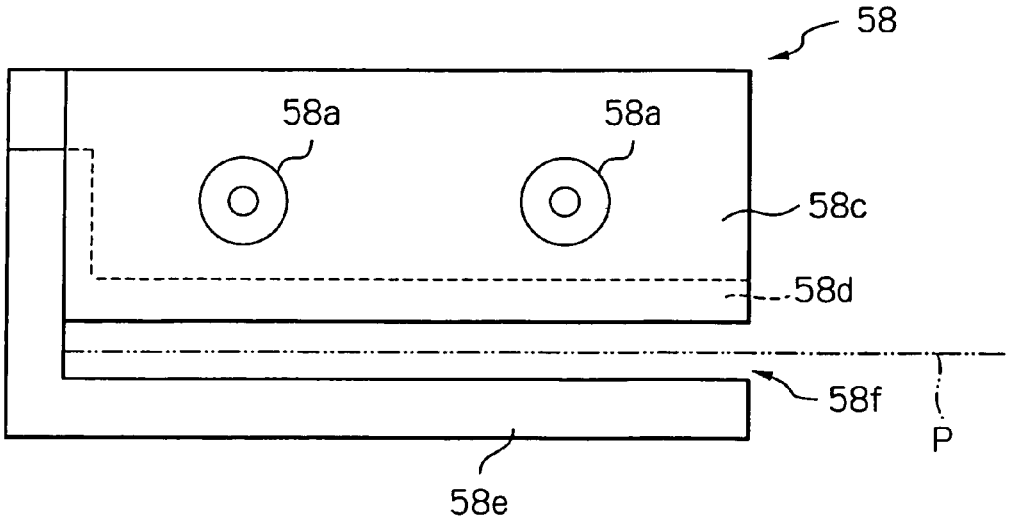
FIG. 11 is a view showing a movable guide included in the fourth embodiment.

In light of the above, as shown in FIG. 11, the movable guide 58 included in the illustrative embodiment is made up of a guiding member or first member 58*d* and a laying member or second member 58*e* constructed integrally with each other. The guiding member 58*d* includes side plates 58*c* (only one is visible; not shown in FIG. 9), rotatably supporting rollers 58*a* while the laying member 58*e* allows the leading edge of the sheet P to be laid thereon. A space 58*f* is provided between the bottom of the guiding member 58*d* and the top of the laying member 58*e* in order to allow the sheet P to be discharged to the outside of the printer body.

In the above construction, even if the support member 49 is pulled out from the printer body 88 with the sheet P being laid on the refeed conveyor 57, the discharge member 89, pulled out together with the support member 49, forces the side edge of the sheet P outward for thereby preventing the sheet P from being left in the printer body 88 and bringing about a jam. The illustrative embodiment is therefore successful to promote more efficient removal of a jamming sheet or more efficient replacement or maintenance of various parts than the second embodiment.

While the discharge member 89 has been shown and described as being applied to the support member 49 of the second embodiment, it is similarly applicable to the support member 81 of the third embodiment for achieving the above effect.

Figure 12:
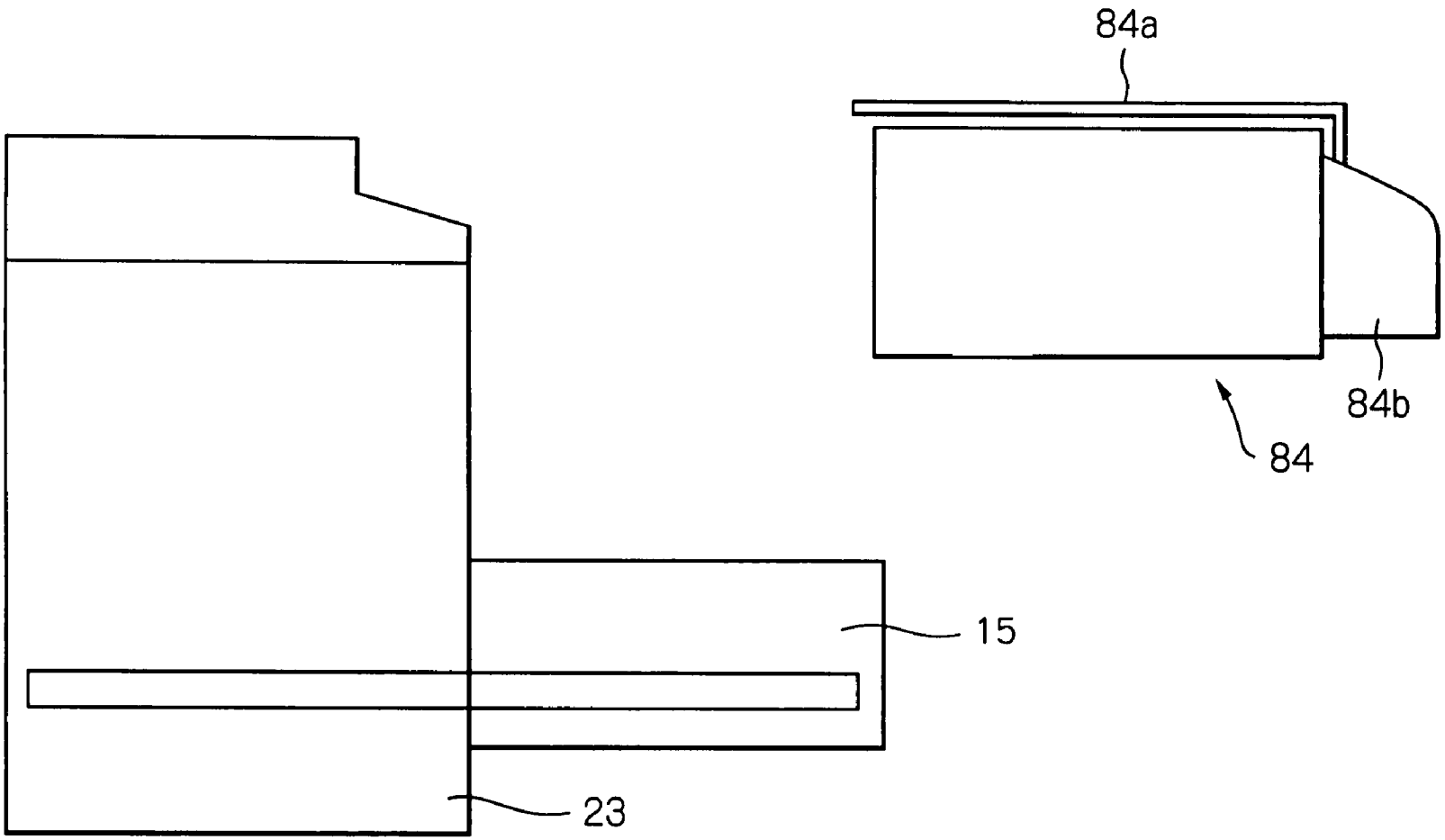
FIG. 12 is a side elevation showing the general construction of the stencil printer in accordance with the present invention.

FIG. 12 shows a fifth embodiment of the stencil printer in accordance with the present invention. The fifth embodiment is identical with the first embodiment except that a print drum 84 removably mounted to the printer body 23 is substituted for the print drum 5.

In the illustrative embodiment, ink feeding means similar to that of the print drum 5 is arranged in the print drum 84 while a stage and a clamper are mounted on the circumferential surface of the print drum 84, although not shown specifically. An ink pump and an ink pack, not shown, are provided integrally with the print drum 84. A rail member 84*a* is mounted on the top of the print drum 84 while a knob 84*b* is affixed to the end of the print drum 84 corresponding to the front end of the printer body 23. To mount the print drum 84 to the printer body 23, the operator fits the rail member 84*a* in a rail guide, not shown, mounted on the printer body 23 and then slides the print drum 84 into the printer body 23.

Figure 13:
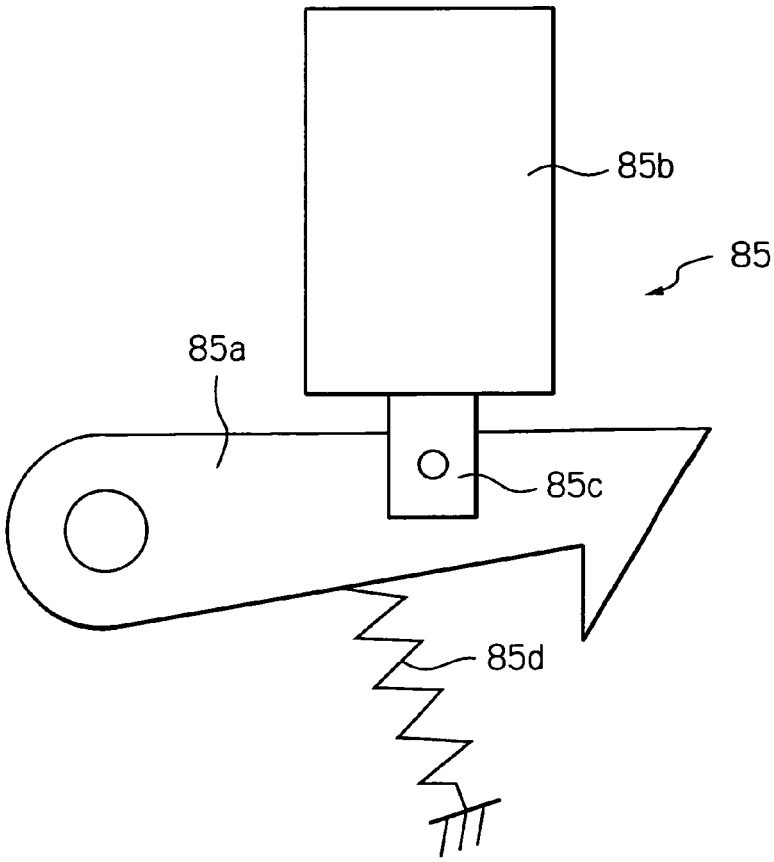
FIG. 13 is a view showing locking means included in a fifth embodiment of the stencil printer in accordance with the present invention.

FIG. 13 shows locking means 85 for selectively locking or unlocking the print drum 84 to the printer body 23. As shown, the locking means 85 is made up of a restricting member 85*a* angularly movably supported by the printer body 23 at one end and having a hook-like free end, a pull-type solenoid 85*b* mounted on the printer body 23 and having a plunger 85*c* movably engaged with the restricting member 85*a*, and a tension spring 85*d* constantly biasing the restricting member 85*a* clockwise as viewed in FIG. 9. When the print drum 84 is inserted into the printer body 23 to a preselected position in a condition wherein the solenoid 85*b* is not energized, the free end of the restricting member 85*a* catches a preselected portion of the print drum 84 under the action of the tension spring 85*d* to thereby lock the print drum 84 to the printer body 23.

Figure 14:
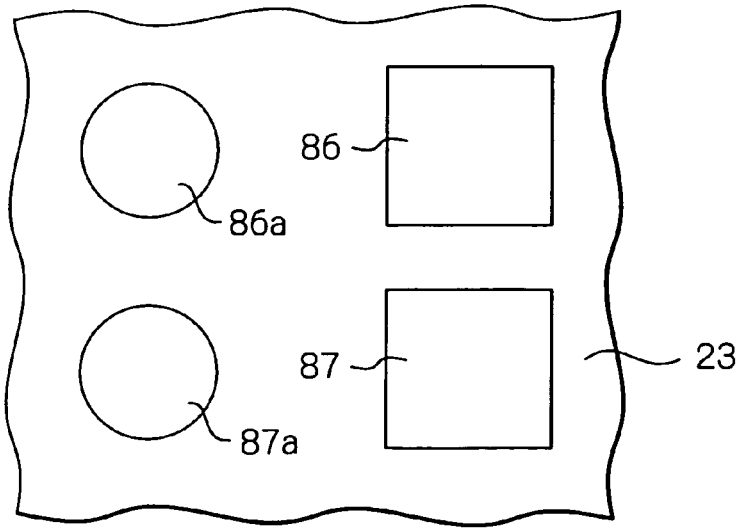
FIG. 14 is a view showing a specific configuration of unlock switches included in the fifth embodiment.

FIG. 14 shows a specific arrangement of unlock switches arranged on the top front of the printer body 23. As shown, the unlock switches are implemented as switches 86 and 87 to which LEDs (Light Emitting Diodes) 86*a* and 87*a*, respectively, are assigned. Assume that the operator mounts the support member 15 and print drum 84 to the printer body 23 to a position where the support member 15 and print drum 84 are locked to the printer body 23 by a locking device, not shown, and restricting means 85, respectively, and then pushes the switch 86. Then, the LED 86*a* is turned on while the solenoid 85*b* is energized to angularly move the restricting member 85*a* counterclockwise, as viewed in FIG. 13, to thereby unlock the print drum 84 from the print drum 23, allowing the print drum 84 to be removed from the printer body 23. When the operator pushes the other switch 87, the LED 87*a* is turned on while the locking device similar in configuration to the restricting means 85 is operated to unlock the support member 15 from the printer body 23, allowing the support member 15 from being removed from the printer body 23.

In the above configuration, sensing means, not shown, responsive to the support member 15 pulled out from the printer body 23 may be used to maintain the solenoid 85*b* turned off even if the operator pushes the switch 86 when the support member 15 is held in a position pulled out from the printer body 23, thereby inhibiting the print drum 84 from being dismounted from the printer body 23. This successfully prevents the circumferential surface of the print drum 84 from contacting, e.g., the press roller 6 or the moving means 22 mounted on the support member 15, which is pulled out from the printer body 23, and being damaged thereby when mounted to or dismounted from the printer body 23, thereby obviating defective printing.

Likewise, sensing means, not shown, responsive to the print drum 84 pulled out from the printer body 23 may be used to maintain the locking device, not shown, inoperative even if the operator pushes the switch 87 when the print drum 84 is held in a position pulled out from the printer body 23, thereby inhibiting the support member 15 from being dismounted from the printer body 23. This successfully prevents any part mounted on the support member 15 from contacting and damaging the circumferential surface of the print drum 84 when mounted to or dismounted from the printer body 23, thereby obviating defective printing.

While the print drum 84 removable from the printer body 23 has been shown and described as being applied to the first embodiment in place of the print drum 5, such a print drum may be similarly applied to any one of the second to fourth embodiments, if desired. When the print drum 84 is applied to the second or the fourth embodiment, the mounting/dismounting of the print drum 84 or the pullout/insertion of the support member 49 will be controlled in accordance with the position of the support member 49 or the position of the print drum 84, respectively. Likewise, when the print drum 84 is applied to the third or the fourth embodiment, the mounting/dismounting of the print drum 84 or the pullout/insertion of the support members 80 and 81 will be controlled in accordance with the positions of the support members 80 and 81 or the position of the print drum 84.

In summary, it will be seen that the present invention provides a stencil printer allowing the operator of the printer to remove a sheet jammed around pressing means after pulling out a support member from a printer body toward the operator and therefore in a broad space, thereby noticeably enhancing efficient work. In addition, even the replacement of the pressing means or the replacement or adjustment of any other part mounted on the support member can be efficiently performed.

Further, the stencil printer of the present invention is configured to inhibit a print drum from being dismounted from the printer body when the support member is held in a position pulled out from the printer body. This prevents the circumferential surface of the print drum from contacting the pressing means or moving means supported by the support member and being scratched or otherwise damaged thereby when mounted to or dismounted from the printer body, also obviating defective printing.

Various modifications will become possible for those skilled in the art after receiving the teachings of the present disclosure without departing from the scope thereof.

What is claimed is:

1. A stencil printer, comprising:

a printer body;

a print drum rotatably mounted on said printer body;

guide members mounted on said printer body;

pressing means for pressing a sheet against an outer circumferential surface of said print drum; and moving means for selectively moving said pressing means into or out of contact with the outer circumferential surface of said print drum, wherein said pressing means and said moving means are configured to be pulled out from said printer body integrally with each other along said guide members.

2. The stencil printer as claimed in claim 1, wherein said pressing means and said moving means are selectively mountable to or dismountable from said printer body integrally with each other.

3. The stencil printer as claimed in claim 1, wherein said print drum is removably supported by said printer body.

4. The stencil printer as claimed in claim 1, further comprising: locking means for inhibiting said print drum from being dismounted from said printer body when said pressing means and said moving means are held in a position pulled out from said printer body.

5. The stencil printer as claimed in claim 4, wherein said locking means comprises a restricting member configured to catch a portion of said print drum when said pressing means and said moving means are pulled out from said printer body, thereby inhibiting said print drum from being dismounted from said printer body.

6. A stencil printer operable in a duplex print mode for printing an image on one surface of a sheet and then printing an image on a reverse surface of said sheet, said stencil printer comprising:

a printer body;

a printing section comprising a print drum configured to wrap a divided master around said print drum, and the divided master has a first image and a second image formed therein side by side in a direction of rotation of said print drum, guide members mounted on said printer body, pressing means selectively movable into or out of contact with said print drum, and moving means for selectively moving said pressing means into or out of contact with said print drum;

a sheet discharging section configured to discharge the sheet undergone printing at said printing section;

refeeding means for temporarily supporting the sheet carrying the image on the one surface thereof and then refeeding said sheet toward said printing section, and said refeeding means is configured to be pulled out from said printer body along said guide members; and a path selector configured to steer the sheet passed through said printing section to either one of said refeeding means and said sheet discharging section, wherein said pressing means and said moving means are configured to be pulled out of said printer body integrally with each other along said guide members.

7. The stencil printer as claimed in claim 6, wherein said pressing means and said moving means are selectively mountable or dismountable from said printer body integrally with each other.

8. The stencil printer as claimed in claim 6, wherein said refeeding means is selectively mountable to or dismountable from said printer body.

9. The stencil printer as claimed in claim 6 further comprising: a discharge member configured to discharge, when said refeeding means is pulled out from said printer body, a sheet laid on said refeeding means to an outside of said printer body together with said refeeding means.

10. The stencil printer as claimed in claim 9, wherein said printer body includes a movable guide positioned above said refeeding means and movable back and forth in a direction identical with a direction of sheet conveyance for receiving one edge of a sheet fed from said printing section, said movable guide comprises a first member including a support member movably supported by said printer body and a second member provided integrally with said first member such that the one edge of the sheet is laid, and a space is formed between said first member and said second member for causing, when said refeeding means is pulled out from said printer body, the sheet laid on said refeeding means to be discharged to the outside of said printer body together with said refeeding means.

11. The stencil printer as claimed in claim 6, wherein said print drum is removably supported by said printer body.

12. The stencil printer as claimed in claim 6, further comprising locking means for inhibiting said print drum from being dismounted from said printer body when said pressing means and said refeeding means are held in a position pulled out from said printer body.

13. The stencil printer as claimed in claim 12, wherein said locking means includes a restricting member configured to catch a portion of said print drum when said pressing means and said moving means are pulled out from said printer, thereby inhibiting said print drum from being dismounted from said printer body.

14. A stencil printer, comprising:

a printer body;

a print drum rotatably mounted on said printer body;

guide members mounted on said printer body;

a pressing member configured to press a sheet against an outer circumferential surface of said print drum; and a moving device configured to selectively move said pressing member into or out of contact with the outer circumferential surface of said print drum, wherein said pressing member and said moving device are configured to be pulled out from said printer body integrally with each other along said guide members.

15. The stencil printer as claimed in claim 14, wherein said pressing member and said moving device are selectively mountable to or dismountable from said printer body integrally with each other.

16. The stencil printer as claimed in claim 14, wherein said print drum is removably supported by said printer body.

17. The stencil printer as claimed in claim 14, further comprising: a locking device configured to inhibit said print drum from being dismounted from said printer body when said pressing member and said moving device are held in a position pulled out from said printer body.

18. The stencil printer as claimed in claim 17, wherein said locking device comprises a restricting member configured to catch a portion of said print drum when said pressing member and said moving device are pulled out from said printer body, thereby inhibiting said print drum from being dismounted from said printer body.

19. A stencil-printer operable in a duplex print mode for printing an image on one surface of a sheet and then printing an image on a reverse surface of said sheet, said stencil printer comprising:

a printer body;

a printing section comprising a print drum configured to wrap a divided master around said print drum, and the divided master has a first image and a second image formed therein side by side in a direction of rotation of said print drum, guide members mounted on said printer body, a pressing member selectively movable into or out of contact with said print drum, and a moving device configured to selectively move said pressing member into or out of contact with said print drum;

a sheet discharging section configured to discharge the sheet undergone printing at said printing section;

a refeeding device configured to temporarily support the sheet carrying the image on the one surface thereof and then refeed said sheet toward said printing section, and said refeeding device is configured to be pulled out from said printer body along said guide members; and a path selector configured to steer the sheet passed through said printing section to either one of said refeeding device and a sheet discharging section;

wherein said pressing member and said moving device are configured to be pulled out of said printer body integrally with each other along said guide members.

20. The stencil printer as claimed in claim 19, wherein said pressing member and said moving device are selectively mountable or dismountable from said printer body integrally with each other.

21. The stencil printer as claimed in claim 19, wherein said refeeding device is selectively mountable to or dismountable from said printer body.

22. The stencil printer as claimed in claim 19, further comprising:

a discharge member configured to discharge, when said refeeding device is pulled out from said printer body, a sheet laid on said refeeding device to an outside of said printer body together with said refeeding device.

23. The stencil printer as claimed in claim 22, wherein said printer body includes a movable guide positioned above said refeeding device and movable back and forth in a direction identical with a direction of sheet conveyance for receiving one edge of a sheet fed from said printing section, said movable guide comprises a first member including a support member movably supported by said printer body and a second member provided integrally with said first member such that the one edge of the sheet is laid, and a space is formed between said first member and said second member for causing, when said refeeding device is pulled out from said printer body, the sheet laid on said refeeding device to be discharged to the outside of said printer body together with said refeeding device.

24. The stencil printer as claimed in claim 19, wherein said print drum is removably supported by said printer body.

25. The stencil printer as claimed in claim 19, further comprising a locking device configured to inhibit said print drum from being dismounted from said printer body when said pressing member and said refeeding device are held in a position pulled out from said printer body.

26. The stencil printer as claimed in claim 25, wherein said locking device includes a restricting member configured to catch a portion of said print drum when said pressing member and said moving device are pulled out from said printer body, thereby inhibiting said print drum from being dismounted from said printer body.

* * * * *